United States Patent [19]

Jones

[11] 4,024,364

[45] May 17, 1977

[54] PRESSURE SWITCH MECHANISM AND CAM STOP ARRANGEMENT THEREFOR

[75] Inventor: William H. Jones, Villa Park, Ill.

[73] Assignee: Eaton Corporation, Cleveland, Ohio

[22] Filed: Nov. 28, 1975

[21] Appl. No.: 636,001

[52] U.S. Cl. ..... 200/83 S; 200/153 LB; 335/194; 74/519

[51] Int. Cl.[2] ..... H01H 35/34

[58] Field of Search ..... 200/83 P, 83 S, 83 SA, 200/327, 153 LB; 335/194; 74/516, 519, 522

[56] References Cited

UNITED STATES PATENTS

| | | | |
|---|---|---|---|
| 2,934,618 | 4/1960 | Beller | 200/83 P |
| 3,846,600 | 11/1974 | Kolze | 200/83 S |

*Primary Examiner*—Gerald P. Tolin
*Attorney, Agent, or Firm*—Teagno & Toddy

[57] ABSTRACT

An improved calibration mechanism is provided for use on a pressure switch having an adjustable, spring biased plunger arrangement for controlling the pressure level required to actuate the switch. The mechanism includes a support bracket, a cam rotatably supported by the bracket and a plunger adjustment lever, including a cam follower in engagement with a surface of the cam. The support bracket defines a guide slot into which the cam follower extends, transverse movement of the cam follower being limited by the guide slot. The cam surface defines a range of pressure settings between the normal low and the normal high as well as a switch reset position adjacent the normal high setting position. The guide slot includes a stop surface which engages the cam follower when the cam is turned to the reset position, and the configuration of the cam, plus the engagement of the follower and the stop surface, prevents further turning of the cam. This arrangement provides a positive stop for the cam rotation and makes it possible to eliminate corners on the cam which might interfere with the wiring.

5 Claims, 6 Drawing Figures

PRESSURE SWITCH MECHANISM AND CAM STOP ARRANGEMENT THEREFOR

BACKGROUND OF THE DISCLOSURE

The present invention relates to calibration mechanisms for pressure switches, and more particularly, to an improved arrangement for stopping or limiting cam rotation.

The invention is particularly applicable to pressure switches for use in controlling the water-fill level of various appliances such as washing machines and dishwashers, and will be described in connection therewith. However, it will be appreciated by those skilled in the art that the invention may be used advantageously in any calibration mechanism of the type having a rotatable cam member and a movable cam follower for selecting among a range of actuation to be sensed by the associated mechanism.

In typical prior art actuating mechanisms, the cam profiles have been provided with projecting portions on either side of the portion of the cam profile which corresponds to the pressure level settings between the normal low and normal high. These projections have been employed as cam stops to limit rotation of the cam in either direction. The cam stop arrangement is especially important as it relates to the cam positions corresponding to a pressure level setting in excess of the normal high setting. The reason is that in a typical pressure switch mechanism, an excessively high pressure setting will result in flooding because even a full tube of water will not exert sufficient pressure on the pressure switch diaphragm to activate the switch, shutting off the flow of water.

Several examples of conventional prior art cam profiles, utilizing projecting portions as stops, are illustrated in U.S. Pat. Nos. 2,934,618 and 3,230,328. One problem associated with the use of such projections has been the tendency of the projections to engage and become entangled with the lead wires during the rotation of the cam. When this occurs, it is quite possible for a lead wire to be pulled loose from its terminal, interfering with the electrical circuitry which shuts off the water-full function, and causing flooding.

SUMMARY OF THE INVENTION

Accordingly, it is an object of the present invention to provide a calibration mechanism for a pressure switch which minimizes the need for projecting portions of the cam to serve as cam rotation stops.

It is a more specific object of the present invention to provide such a calibration mechanism which utilizes associated structure, such as the support bracket, to stop cam rotation, rather than using stop surfaces on the cam member to prevent rotation thereof.

It is a related object of the present invention to provide a calibration mechanism which accomplishes the above-stated objects and which utilizes a smooth cam profile, free of sharp corners and projections, capable of engaging and fouling the wiring.

The above and other objects of the present invention are accomplished by the provision of an improved calibration mechanism for a pressure switch of the type having a spring-biased plunger arrangement adjustable to establish different pressure levels required to actuate the switch. The calibration mechanism comprises a support bracket mounted on the pressure switch and a cam member rotatably supported by the support bracket and defining a cam surface. A plunger adjustment means is pivotally mounted relative to the support bracket and includes a cam follower in following engagement with the cam surface. The cam surface defines a range of cam follower positions corresponding to a range of pressure level settings between the normal low and the normal high settings, and the cam surface further includes a second surface portion disposed to define a follower position corresponding to a pressure level setting greater than the normal high setting. The support bracket defines a stop surface disposed to engage the cam follower when the cam follower is in engagement with the second surface portion of the cam member, the surface portion being configured to prevent further rotation of the cam toward a position corresponding to a higher pressur level setting when the cam follower engages the stop surface.

DESCRIPTION OF THE PREFERRED EMBODIMENTS

Figure 1:
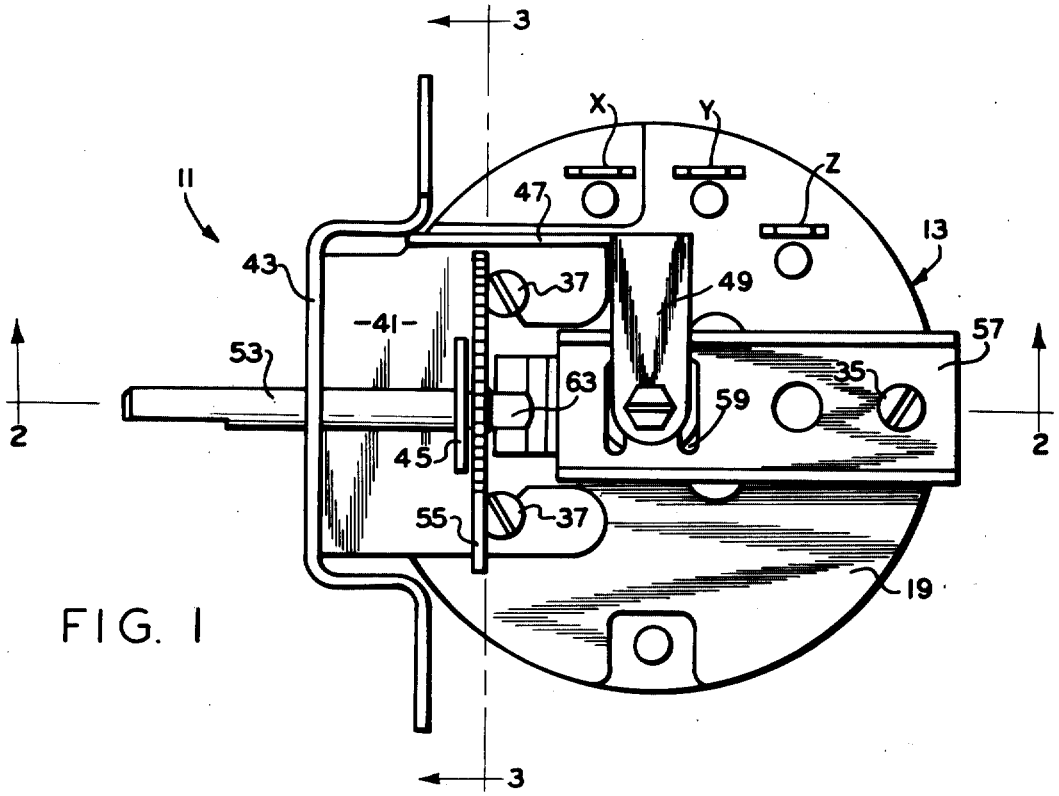
FIG. 1 is a top plan view of the pressure switch mechanism of the present invention.
Figure 2:
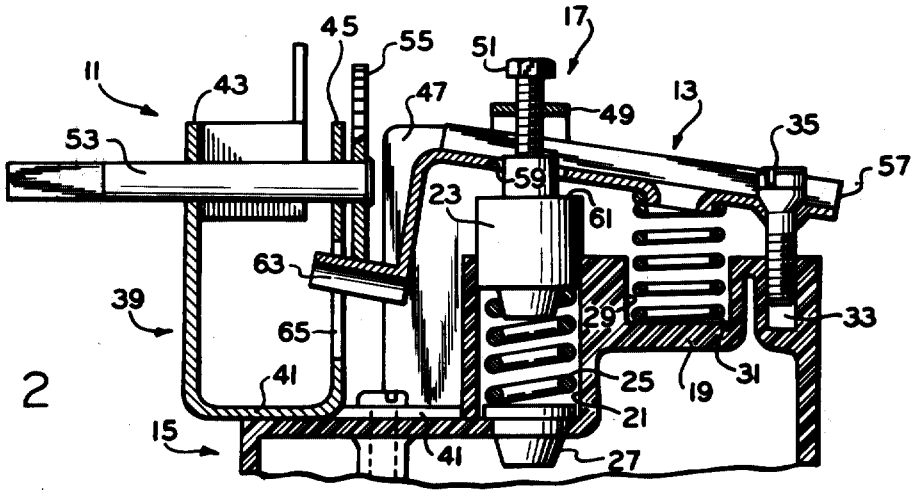
FIG. 2 is a cross section taken on line 2—2 of FIG. 1.

Referring now to the drawings, which are not intended to limit the present invention, FIGS. 1 and 2 illustrate a pressure switch mechanism, generally designated 11, of the type to which the present invention may be applied. The pressure switch mechanism 11 includes an actuation portion 13 and a switch portion 15 (fragmentarily shown in FIG. 2). Because the switch portion 15, by itself, does not form a feature of the present invention and because its construction is well-known to those skilled in the art, the details of the switch portion 15 are not shown or described herein. It is sufficient to an understanding of the present invention that the switch portion 15 includes a movable switch member (not shown), responding to a pressure which is determined by the setting of a plunger assembly, generally designated 17.

The actuation portion 13 includes an upper housing portion 19, which defines a bore 21 for receiving a plunger 23 therein. Plunger 23 is biased upwardly within the bore 21 by means of a helical compression spring 25, which is seated, at its lower end, upon the upper surface of an actuator member 27. The housing portion 19 also defines a second bore 29 in which is seated a spring 31, and a threaded bore 33, which threadedly receives a calibration screw 35, the function of which will be described subsequently.

Attached to the upper surface of housing portion 19, such as by means of a pair of screws 37, is a support bracket, generally designated 39, of the type well-known in the art. As may best be seen in FIG. 2, the support bracket 39 includes a generally flat base portion 41 and a generally U-shaped portion including part of the base portion 41, an upwardly-extending forward leg 43 and an upwardly-extending rear leg 45. In addition, the support bracket 39 includes an upwardly-extending wall portion 47, and extending from the top of wall portion 47 is a right-angled tab portion 49. In threaded engagement with the tap portion 49 is a calibration screw 51 which comprises a portion of the plunger assembly 17, the screw 51 having its lower end in engagement with the upper surface of plunger 23, thus controlling the position of the plunger 23 relative to the bore 21.

Also attached to the upper surface of housing portion 19 are several terminals, X, Y and Z, each of which is connected to a part of the switch portion 15 as is well-known in the art. A wiring harness (not shown) includes one field wire connected to each of the terminals.

Extending through, and rotatably supported by forward leg 43 and rear leg 45, is a cam shaft 53 having a cam member 55 fixedly attached adjacent to the right end of the cam shaft 53. As is well-known in the art, the cam 55 is rotatable about the longitudinal axis of the cam shaft 53 and controls the vertical position of a lever 57. The lever 57 has one end fixed relative to the housing portion 19 by means of calibration screw 35, and is biased upwardly by means of spring 31 seated against the underside of lever 57. Lever 57 defines an opening 59 through which the smaller, upper portion of plunger 23 extends, such that during normal operating conditions, the underside of the plunger 23 is in engagement with upper surface 61. At the forward end of lever 57, and integrally formed with the lever 57, is a cam follower 63 which, in the subject embodiment, has a generally semicircular configuration (see FIGS. 3 and 4).

Figure 3:
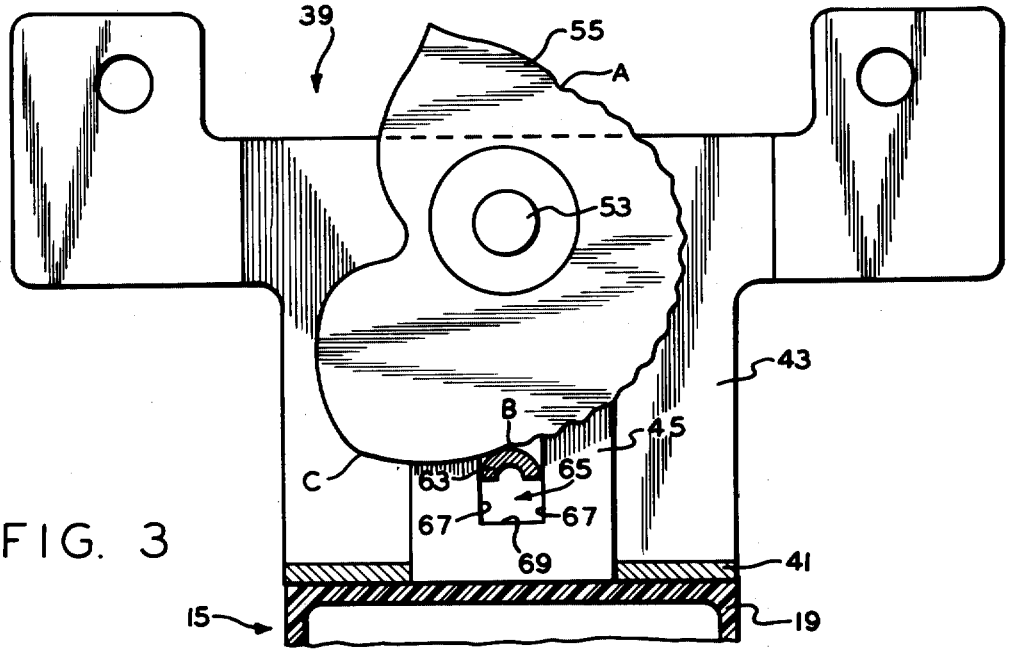
FIG. 3 is a cross section illustrating the cam of the present invention, and taken on line 3—3 of FIG. 1.
Figure 4:
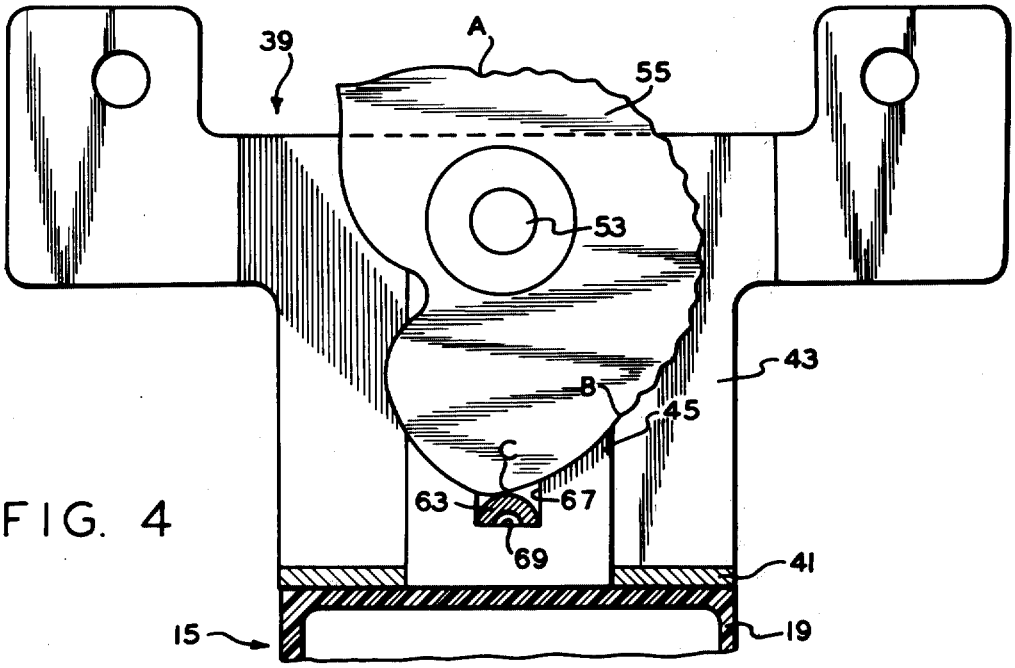
FIG. 4 is a view similar to FIG. 3 with the cam in a different operating position.

Referring now to FIGS. 3 and 4, in conjunction with FIGS. 1 and 2, it may be seen that the upward biasing force exerted by spring 31 on lever 57, as lever 57 pivots about calibration screw 35, maintains cam follower 63 in engagement with the profile (i.e., the peripheral surface) of cam 55. The cam profile includes a point A corresponding to the normal low pressure setting and a point B corresponding to the normal high pressure setting, with the serrated cam profile extending between points A and B comprising the normal operating range. Thus, in FIG. 3 the cam 55 is turned to the normal high setting.

It may be seen in FIGS. 3 and 4 that the rear leg 45 of support bracket 39 define an elongated slot 65, with the cam follower 63 projecting through the slot 65. As may best be seen in FIG. 3, the slot 65 includes a pair of oppositely disposed side surfaces 67 and a bottom, stop surface 69, the function of which will be described subsequently.

In addition to points A and B which define the extent of the normal low-to-high range of pressure settings, the cam 55 includes point C which corresponds to a pressure setting in excess of the normal high setting at point B, i.e., a setting which results in a greater downward biasing force on the setting which results in a greater downward biasing force on the actuator member 27. When the cam 55 is rotated such that the cam follower 63 is an engagement with the cam profile at point C (see FIG. 4), this is commonly referred to as the "reset" position of the cam, wherein the switch member in switch portion 15 is returned from the actuator position to the unactuated position. In the subject embodiment, it would be undesirable for the cam 55 to be rotated any further in a counterclockwise direction than the position shown in FIG. 4. Therefore, the present invention contemplates that the stop surface 69 be positioned such that when the cam 55 is rotated to a position where point C contacts the cam follower 63, the cam follower 63 almost simultaneously engages the stop surface 69. This limitation of the downward movement of cam follower 63, when the slope of the cam profile is still increasing, prevents further counterclockwise rotation of the cam 55. It will be appreciated by those skilled in the art that, within the scope of the present invention, the stop surface 69 may generally be disposed at whatever position is necessary in order for the cam follower to engage the stop surface 69 and prevent further rotation of the cam toward a position corresponding to a pressure setting which is higher than the desired maximum setting for the particular actuation mechanism.

Figure 5:
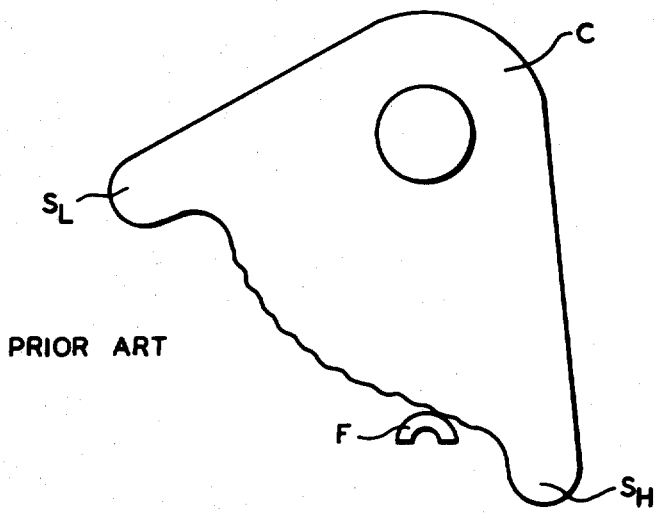
PRIOR ART FIG. 5
FIG. 5 is a view similar to FIGS. 3 and 4 illustrating a prior art cam configuration.
Figure 6:
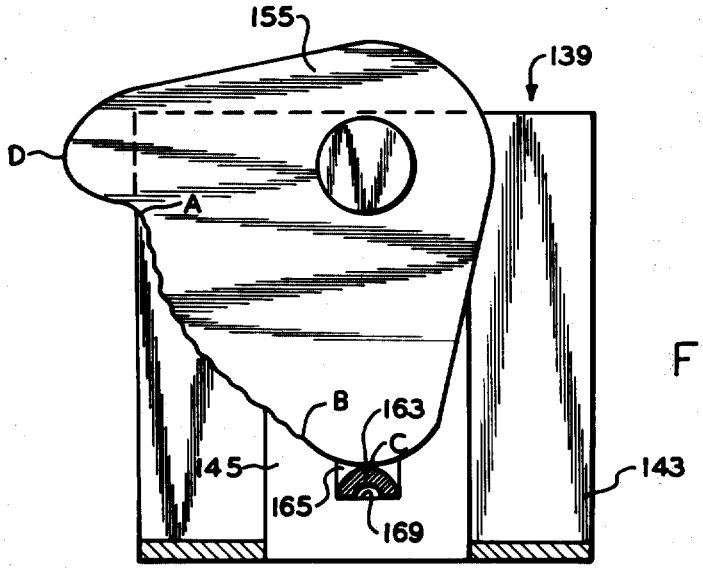
FIG. 6 is a view similar to FIG. 5 illustrating the application of the present invention to a cam such as that shown in FIG. 5.

Referring now to FIGS. 5 and 6, in which like elements are referred to by like numerals, plus 100, FIG. 5 illustrates a typical prior art cam and follower arrangement, such as could be utilized with the pressure switch mechanism of FIGS. 1 and 2. The prior art arrangement includes a cam C defining a cam profile in engagement with a cam follower F. Adjacent the low pressure end of the cam profile, the cam C defines a stop portion $S_L$, while adjacent the high pressure end of the profile, the cam C includes a stop portion $S_H$. It will be understood by those skilled in the art that with the prior art arrangement shown in FIG. 5, there is greater difficulty in guarding or shielding any adjacent wiring harness to prevent entanglement of the wiring with either of the stop portions $S_L$ or $S_H$. In addition, for either direction of rotation, engagement of the follower F and the respective stop portion ($S_L$ or $S_H$) will result in a transverse force on the cam follower, as well as a torsional force on the cam and its associated shafts and supports, thus increasing the likelihood of damage and/or wear of the mechanism.

FIG. 6 illustrates an alternative embodiment of the present invention in which a cam 155 has a profile substantially identical to that of the prior art cam C, but with the stop portions $S_L$ and $S_H$ removed to facilitate shielding of associated wire harnesses. This mechanism includes a support bracket 139 having a foreward leg 143 and a rear leg 145. The rear leg 145 defines a slot 165 including a bottom, stop surface 169, such that when the cam 155 is rotated clockwise from the low pressure setting (point A) past the high pressure setting (point B) to the maximum desired pressure setting, or "reset" position (point C), the cam follower 163 engages the stop surface 169, thus limiting the downward movement of the follower 163 and preventing further rotation of the cam 155. Likewise, if the cam 155 is rotated counterclockwise past point A, a second "reset" position (point D) will engage the follower 163 which, in turn, will engage stop surface 169 to limit further counterclockwise rotation of the cam 155.

I claim:

1. A calibration mechanism for a pressure switch of the type having a spring-biased plunger arrangement adjustable to establish different pressure levels required to actuate the switch, said calibration mechanism comprising:

a. a support bracket assembly fixedly mounted relative to the body of the pressure switch;

b. a cam member supported by said bracket assembly and mounted to be rotatable about an axis fixed relative to said bracket assembly, said cam member defining a cam surface;

c. plunger adjustment means pivotally mounted relative to said bracket assembly, and including a cam follower in following engagement with said cam surface;

d. said cam surface defining a range of cam follower positions corresponding to a range of pressure level settings between a normal low setting and a normal high setting;

e. said cam including a second surface portion disposed to define a follower position corresponding to a pressure level setting greater than said normal high setting;

f. said support bracket assembly defines a stop surface disposed to engage said cam follower when said cam follower is in following engagement with said second surface portion of said cam surface;

g. said second surface portion being configured to prevent further rotation of said cam member toward a position corresponding to a higher pressure level setting when said cam follower engages said stop surface.

2. A calibration mechanism for a pressure switch of the type including a pivotal lever member movable to establish different pressure levels required for actuation of the pressure switch, said calibration mechanism comprising:

a. a support bracket assembly fixedly mounted relative to the pressure switch;

b. a cam assembly including a cam shaft rotatably supported by said support bracket assembly and a cam member defining a cam surface;

c. said lever including a cam follower in following engagement with said cam surface;

d. said support bracket assembly defining a guide slot receiving said cam follower therein and limiting transverse movement of said cam follower;

e. said cam surface defining a range of cam follower positions corresponding to a range of pressure level settings between a normal low setting and a normal high setting;

f. said cam member further defining a switch reset surface corresponding to a pressure level setting greater than said normal high setting;

g. said guide slot terminating in a stop surface disposed to engage said cam follower and limit movement thereof when said cam follower is in following engagement with said switch reset surface of said cam member.

3. A calibration mechanism as claimed in claim 2 wherein said switch reset surface is configured to prevent further rotation of said cam member toward a position corresponding to a higher pressure level setting when said cam follower engages said switch reset surface.

4. A calibration mechanism as claimed in claim 2 wherein said lever comprises an elongated member pivotally mounted adjacent an end oppositely disposed from said cam follower.

5. A calibration mechanism as claimed in claim 2 wherein said switch reset surface of said cam member defines a locus of points at a gradually increasing distance from the axis of rotation of said cam member in a direction oppositedly disposed from a follower position corresponding to said normal high setting.

* * * * *